US007787644B2

(12) United States Patent
Akino

(10) Patent No.: US 7,787,644 B2
(45) Date of Patent: Aug. 31, 2010

(54) CONDENSER MICROPHONE

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 1175 days.

(21) Appl. No.: 11/385,719

(22) Filed: Mar. 22, 2006

(65) Prior Publication Data

US 2006/0233399 A1 Oct. 19, 2006

(30) Foreign Application Priority Data

Apr. 18, 2005 (JP) ..... 2005-120140

(51) Int. Cl.
*H04R 25/00* (2006.01)
*H04R 1/09* (2006.01)

(52) U.S. Cl. ..... 381/174; 381/369

(58) Field of Classification Search ..... 381/174, 381/361, 364, 368

See application file for complete search history.

(56) References Cited

U.S. PATENT DOCUMENTS 3,961,202 A * 6/1976 Kono et al. ..... 381/113
2005/0182504 A1* 8/2005 Bailey ..... 381/119

FOREIGN PATENT DOCUMENTS

| | | |
|---|---|---|
| JP | 56-155545 | 11/1981 |
| JP | 08-162735 | 6/1996 |
| JP | 2003-230195 | 8/2003 |
| JP | 2004-007156 | 1/2004 |

OTHER PUBLICATIONS

Japanese Office Action dated Jun. 29, 2010 (with English translation) (7 pgs.).

* cited by examiner

*Primary Examiner*—Brian Ensey
(74) *Attorney, Agent, or Firm*—Oblon, Spivak, McClelland, Maier & Neustadt, L.L.P.

(57) ABSTRACT

In a condenser microphone having a form in which a microphone unit section and a power module section are separated and connected by a dedicated cable, and comprising a screw terminal for connecting the dedicated cable at the power module section, electromagnetic waves are effectively prevented from penetrating through the screw terminal section and noises are prevented from mixing in a voice signal. A power module section has a substrate, a screw terminal section fixed on the substrate and connecting a cable, and a shield case that covers the power module section, and the substrate has a wiring pattern for connecting the circuit of the power module section and the screw terminal section and a high frequency noise countermeasure component connected to the wiring pattern, and the screw terminal section is fixed on the substrate so as to cover the high frequency noise countermeasure component.

6 Claims, 5 Drawing Sheets

CONDENSER MICROPHONE

BACKGROUND OF THE INVENTION

1. Field of the Invention

The present invention relates to a condenser microphone and, more particularly, is effective for a condenser microphone having a form in which a microphone unit section incorporates an impedance converter, and a circuit storage section incorporating a low cut circuit, an output circuit, etc. and the microphone unit section are connected by a dedicated cable.

2. Related Background of the Invention

Since an impedance of a microphone unit for converting voice into electric signals is high, an impedance converter configured mainly by a FET (Field Effect Transistor) is used in a condenser microphone. Further, in order to enhance performance as a microphone, a low cut circuit, an output circuit, etc., are incorporated in the microphone.

Microphones are manufactured in a variety of forms according to their uses. In a use in which the presence of a microphone is inconspicuous, it does not bring any problem even if the microphone has a certain volume, therefore, it is possible to incorporate circuit sections such as the impedance converter, the low cut circuit, the output circuit, etc., described above in the microphone case. However, a microphone for conference, a microphone for a church choir, a tiepin-type microphone, etc., are needed to be reduced in size so that the microphone itself is inconspicuous, therefore, it is not possible to incorporate all of the circuit sections in the microphone case. Because of this, for the microphone for conference, the microphone for a church choir, the tiepin-type microphone, etc., (hereinafter, these are referred to as "compact microphones"), a form is employed in which the microphone unit section incorporates the impedance converter, and a circuit storage section incorporating the low cut circuit, the output circuit, etc. and the microphone unit section are connected by a dedicated cable. The voice signal of the microphone is output from the output circuit incorporated in the circuit storage section. A section including the microphone unit and impedance converter is referred to as a "microphone unit section" and the circuit storage section that incorporates the low cut circuit and output circuit is referred to as a "power module section", therefore, the terms "microphone unit section" and "power module section" are used in this specification hereinafter.

The dedicated cable that connects the microphone unit section and power module section is composed of a two-core signal wire and a shielding wire for covering and shielding the signal wire. More specifically, the dedicated line is composed of a power line for supplying power to the microphone unit section, a signal line for transferring a voice signal output from the impedance converter to the power module section, and a shield line for electrostatically shielding and grounding the power line and the signal line. The dedicated cable transmits a voice signal in an unbalanced mode, therefore, may suffer from external noises. If an electromagnetic wave penetrates the dedicated cable from the outside, the electromagnetic wave enters into the microphone unit section and the power module section and it is detected by a semiconductor used in the microphone unit section and the microphone unit section, and noises are produced.

Recently, a mobile phone prevails widely and the situation in which a mobile phone is used in the vicinity of a microphone becomes more likely to occur, and there arises a serious problem in that noises occur in a microphone due to the influence of the high frequency electromagnetic waves used by the mobile phone. In particular, in the case of the compact microphone, inter alia, in the microphone for a choir, the microphone unit section is suspended from the ceiling of a church etc. and the power module section is attached on the upper side of the ceiling plate in order to prevent the appearance of the ceiling from being degraded, therefore, noises due to electromagnetic waves are becoming a problem. FIG. 3 shows an example of such a suspended type microphone. In FIG. 3, a hole for attaching a power module section 2 is drilled in a ceiling 7 of a church etc. and the power module section 2 is buried in the hole with its outer circumferential surface covered with a shield cover 3. The hole of the ceiling plate is blocked up with a panel 4. The panel 4 has a role to make the attached power module section 2 more inconspicuous and to shield the power module section 2. Penetrating through the panel 4, a flexible pipe 5 hangs and at the lower end of the flexible pipe 5, a microphone unit section 1 is attached. To the microphone unit section 1, a dedicated cable is connected as described above, and the dedicated cable runs through the flexible pipe 5 and the respective lines constituting the dedicated cable are connected to a predetermined terminal of the power module section 2. From the power module section 2, a cord 6 is led out on the upper side of the ceiling 7 so that a voice signal enters an external circuit.

Conventional examples of the power module section 2 are shown in FIG. 4 and FIG. 5. The power module section 2 is composed mainly of a substrate 10, a shield case 3, an input side screw terminal 11, and an output side screw terminal 12. On the substrate 10, a circuit section including the low cut circuit and the output circuit is formed, as described above, and it is so designed that a voice signal from the microphone unit section is input to the circuit section via the screw terminal 11 and a plurality of wiring patterns 13 electrically connected to each terminal of the screw terminal 11. To the wiring pattern 13, a high frequency noise countermeasure component 14 composed of a capacitor etc. is connected; noise coming from the outside. The configuration of the output side of the circuit section is substantially the same as that of the input side and a plurality of wiring patterns 15 for outputting a voice signal are electrically connected to the respective terminals of the output side screw terminal 12. To the wiring pattern 15, a high frequency noise countermeasure component 16 is connected. The high frequency noise countermeasure component 14 is arranged at the side of the screw terminal 11 in order to prevent physical interference with the screw terminal 11 and the high frequency noise countermeasure component 16 is arranged at the side of the screw terminal 12 in order to prevent physical interference with the screw terminal 12, respectively, and in accordance with this, part of the wiring patterns 13 and 15 is formed so as to take a circuitous route between the screw terminals 11 and 12 and the circuit section.

The reason that a screw terminal is used in the power module section 2, in particular, the reason that the input side screw terminal 11 is used in the power module section 2 is that it is necessary to adjust the length of the dedicated cable that connects the microphone unit section and the power module section 2. In other words, the length of the dedicated cable differs depending on various conditions such as the height of the ceiling of a building at which a microphone is installed and the dedicated cable is cut into a length suited to the condition for use. Because of this, if the end portion of the dedicated cable is directly connected to the circuit substrate 10 of the power module section 2 by soldering, wiring work is troublesome; therefore, a screw terminal capable of wiring by screwing is used. Since the situation is the same on the output side of the power module section 2, the screw terminal 12 is also used on the output side.

The dimension of the screw terminals 11 and 12 becomes large since a microphone cord is connected by means of mechanical screwing. In addition to this, there exist the plural wiring patterns 13 and 15 exposed without being electrostatically shielded between the circuit section electrostatically shielded by the shield case 3 and the screw terminals 11 and 12. Part of the plural exposed wiring patterns 11 and 12 is formed in a circuitous manner and increased in length as described above, therefore, unprotected against the electromagnetic waves from the outside and it is more likely that a high frequency current enters therethrough. Further, the core wire part exposed from the shield wire of the input/output microphone cord is screwed onto the screw terminals 11 and 12 of the input/output section; therefore, the core wire part exposed from the shield wire is also unprotected against the electromagnetic waves from the outside. Thus, it is configured such that electromagnetic waves are likely to penetrate through the core wire exposed from the shield wire or through the wiring patterns 13 and 15. If electromagnetic waves penetrate through the exposed core wire or the wiring patterns 13 and 15, the electromagnetic waves enter into the shield case 3 of the power module section 2 and as a result, noises are mixed in a voice signal. Although the high frequency noise countermeasure components 16 are connected to the screw terminals 11 and 12, if electromagnetic waves once penetrate through the core wire or the wiring patterns 13 and 15, it is not possible to prevent the electromagnetic waves from causing noises.

Incidentally, in the conventional environment in which electromagnetic waves do not come and go so frequently, the conventional configuration of the power module section 2 has not brought about any problem. This is because it is unlikely that electromagnetic waves penetrate from the outside. However, in such a recent environment in which the individual carries his/her own mobile phone, electromagnetic waves exist everywhere and now the situation is that the influence of the electromagnetic waves on the microphone cannot be ignored. It has been found out that in a condenser microphone in a form shown in FIG. 3, even if the power module section 2 shown in FIG. 4 and FIG. 5 is used, the electromagnetic waves having penetrated through the cable connecting the microphone unit 1 and the power module section 2 enter into the shield case 3 through the wiring patterns 13 and 15 and produce noises. Therefore, countermeasures against noises due to electromagnetic waves are desired in a condenser microphone in a form in which a microphone unit section and a power module section are separated and connected with a cable.

Conventionally, various countermeasures against noises due to electromagnetic waves in a condenser microphone have been proposed. For example, a condenser microphone has been proposed (for example, refer to Japanese Patent Application Laid-Open No. 2004-7156), in which in order to not only electrically stabilize the contact between the condenser microphone main body and a substrate but also reduce the high frequency noise level, in addition to the condenser microphone main body, a spring terminal for outputting a voice signal of the condenser microphone main body and an insulator for causing one end of the spring terminal to come into contact with a contact of the substrate of the condenser microphone main body by attaching the spring terminal are comprised, and the other end of the spring terminal is made into a spiral shape.

Further, an electret condenser microphone has been proposed (for example, refer to Japanese Patent Application Laid-Open No. 2003-230195), in which an electroacoustic transducing section is constituted by charging the inner surface of a front end wall of a capsule and disposing a vibration diaphragm at a position in opposition to the front end wall, the capsule is blocked by engaging a substrate with the rear end portion of the capsule, a FET for transducing the acoustic vibration of the vibration diaphragm into an electric signal is provided to the substrate, and a capacitor and a varistor are further provided in parallel between the FET and a ground terminal.

The respective inventions described in Japanese Patent Application Laid-Open No. 2004-7156 and Japanese Patent Application Laid-Open No. 2003-230195 relate to a microphone of a type incorporated into, for example, a mobile phone and are based on the idea that high frequency noise countermeasure components are additionally provided. In addition, the invention described in Japanese Patent Application Laid-Open No. 2003-230195 is one that the microphone unit section is stored in the capsule and shielded.

However, none of the inventions described in Japanese Patent Application Laid-Open No. 2004-7156 and Japanese Patent Application Laid-Open No. 2003-230195 relate to the high frequency noise countermeasures in a condenser microphone in a form in which a microphone unit section and a power module section are separated and connected by a dedicated cable.

SUMMARY OF THE INVENTION

An object of the present invention is to provide a condenser microphone capable of effectively preventing electromagnetic waves from penetrating through a screw terminal section and preventing noises from mixing in a voice signal, in a condenser microphone having a form in which a microphone unit section and a power module section are separated and connected by a dedicated cable and comprising a screw terminal for connecting the dedicated cable at the power module section.

The present invention is a condenser microphone in a form in which a microphone unit section and a power module section are separated and connected by a cable and is most mainly characterized in that: the power module section has a substrate, a screw terminal section fixed on the substrate and connecting the cable, and a shield case covering the power module section; the substrate has a wiring pattern for connecting the circuit of the power module section with the screw terminal section and a high frequency noise countermeasure component connected to the wiring pattern; and the screw terminal section is fixed on the substrate so as to cover the high frequency noise countermeasure component.

Since the screw terminal section is fixed on the substrate so as to cover the high frequency noise countermeasure component, it is made possible to form the wiring pattern connecting the high frequency noise countermeasure component and connecting to each terminal of the screw terminal section with the minimum distance from the circuit of the power module section, therefore, the exposed portion of the wiring pattern can be extremely reduced. Because of this, it is possible to considerably reduce the electromagnetic waves trying to penetrate the circuit inside the shield case of the power module section through the wiring pattern and to considerably reduce the noises caused by the electromagnetic waves.

DESCRIPTION OF THE PREFERRED EMBODIMENTS

An embodiment of a condenser microphone according to the present invention will be described below with reference to drawings.

Figure 1:
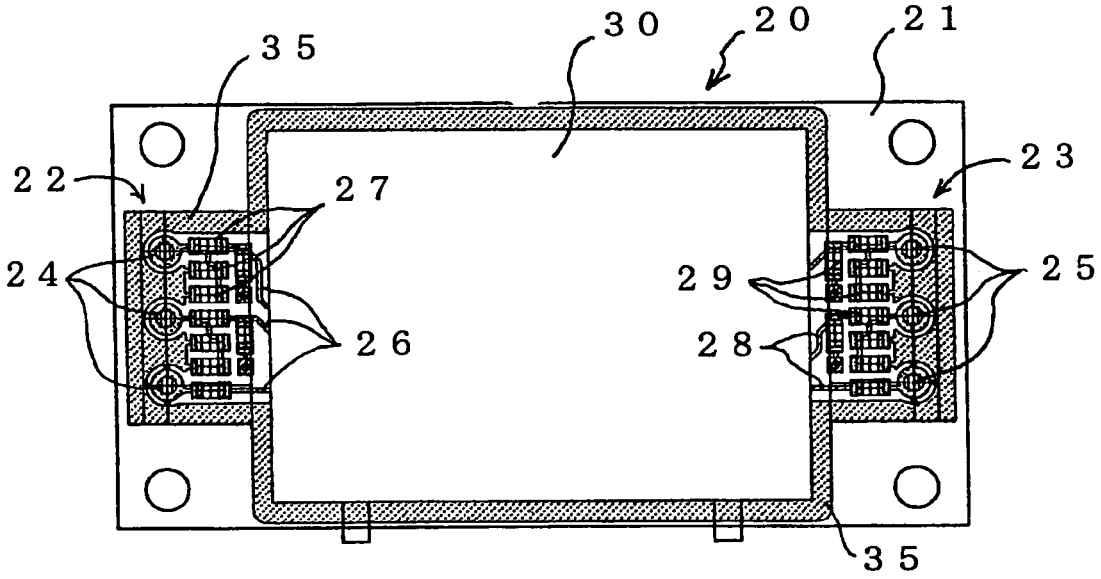
FIG. 1 is a top plan view showing a configuration example of a power module section of a condenser microphone according to the present invention, with part of components being omitted.
Figure 2:
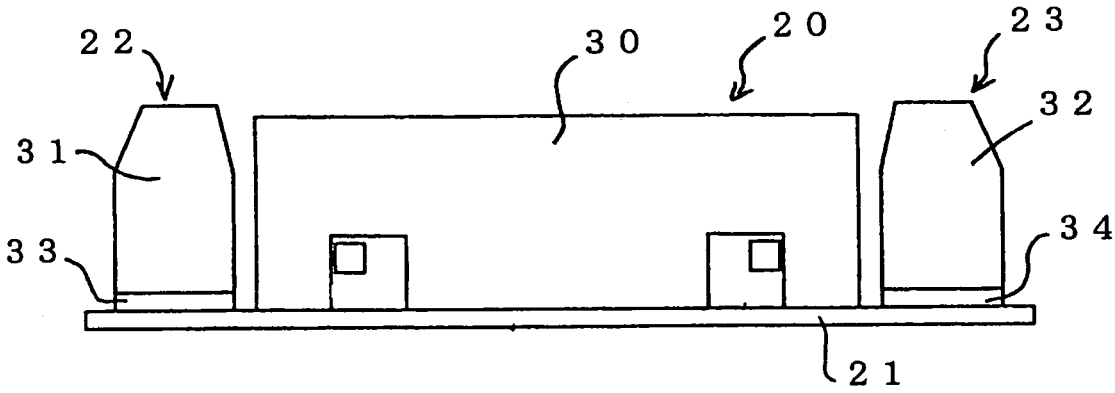
FIG. 2 is a front view of the power module section.
Figure 3:
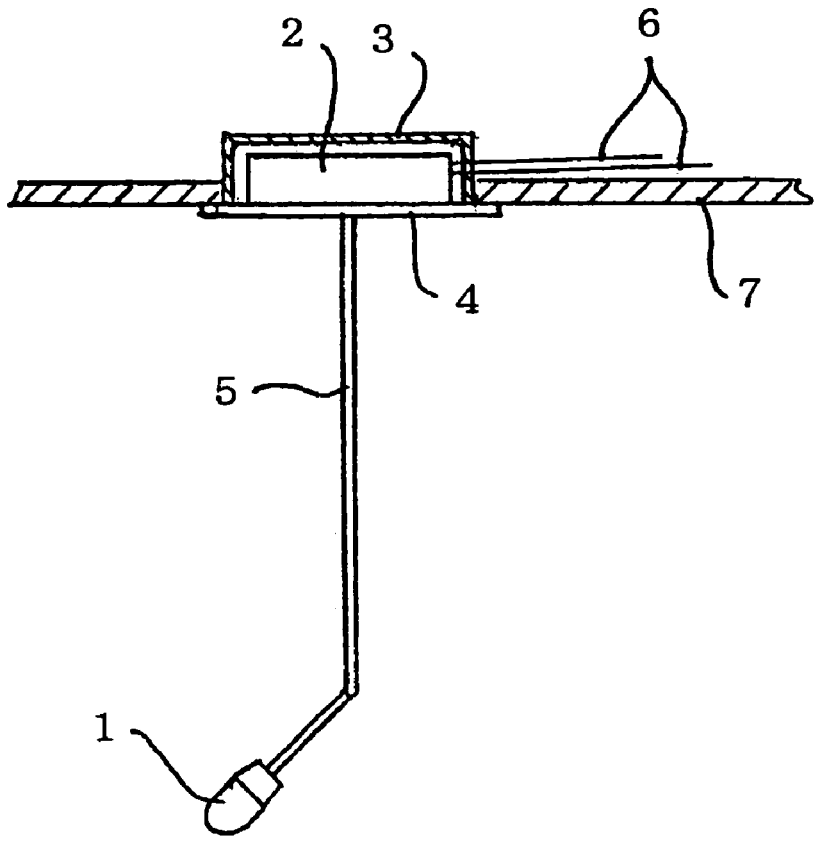
FIG. 3 is a partial section front view showing an application example of the condenser microphone according to the present invention.

In FIG. 1 and FIG. 2, reference numeral 20 denotes a power module section. As described above, the power module section 20 is a circuit storage section for incorporating a low cut circuit and an output circuit. It is possible to use the power module section 20 by burying it in the ceiling as, for example, a power module section in a condenser microphone of ceiling suspended type as shown in FIG. 3. The power module section 20 mainly comprises a substrate 21, a shield case 30, an input side screw terminal section 22, and an output side screw terminal section 23.

On the substrate 21, a circuit including a low cut circuit and an output circuit is formed and it is designed so that a voice signal from the microphone unit section is input to the circuit section via the screw terminal section 22 and a plurality of electrode patterns 24 and wiring patterns 26 electrically connected to each terminal of the screw terminal section 22. The input side screw terminal section 22 is arranged on one end side (on the left end side in FIG. 1 and FIG. 2) of the substrate 21 with the shield case 30 being sandwiched in between. To the respective electrode patterns 24 and wiring patterns 26, and a ground pattern 35, an external high frequency noise countermeasure component 27 composed of a capacitor etc. is connected. The configuration of the circuit section on the output side is substantially the same as the configuration on the input side and a plurality of wiring patterns 28 for outputting a voice signal are electrically connected to the respective electrode patterns 25 of the screw terminal section 23 on the output side. To the wiring pattern 28, the electrode pattern 25, and the ground pattern 35, a high frequency noise countermeasure component 29 composed of a capacitor etc. is connected. The ground pattern 35 is formed so as to enclose the respective wiring patterns and the respective electrode patterns on the input/output side and the circuit section covered with the shield case 30. The screw terminal section 23 on the output side is arranged on the other end side (the right end side in FIG. 1 and FIG. 2) of the substrate 21 with the shield case 30 being sandwiched in between.

The high frequency noise countermeasure component 27 is covered with a terminal part 31 constituting the input side screw terminal section 22, in other words, the terminal part 31 is fixed on the frequency noise countermeasure component 27 so as to overlap therewith. However, between the circuit substrate 21 and the terminal part 31, a spacer 33 is interposed and a gap comparable to the height dimension of the spacer 33 is formed, and the frequency noise countermeasure component 27 is stored within the extent of the gap. The terminal part 31 has an electric wire connection section for screwing to connect a wire for transmitting a voice signal from the microphone unit section, a wire for supplying power, and a shield wire and at the same time, has electrodes electrically integral to the electric wire connection section, and each electrode is electrically connected to the electrode pattern 24. The material of the terminal part 31 is not specified in particular, however, if integral molding of plastic, which is generally an insulating material, is employed, manufacture is simple. The material of the spacer 33 is also arbitrary and it may be an insulating material or a conductive material. The wiring pattern 26 connecting the circuit of the power module section 20 and the screw terminal section 22, and the high frequency noise countermeasure component 27 are enclosed by the spacer 33 in the three directions except in the direction of the shield case 30 side covering the power module section 20.

The screw terminal section 23 on the output side is similarly configured as the screw terminal section 22 on the input side as described below. The high frequency noise countermeasure component 29 is covered with a terminal part 32 constituting the output side screw terminal section 23, in other words, the terminal part 32 is fixed on the frequency noise countermeasure component 29 so as to overlap therewith. However, between the circuit substrate 21 and the terminal part 32, a spacer 34 is interposed and a gap comparable to the height dimension of the spacer 34 is formed, and the frequency noise countermeasure component 29 is stored within the extent of the gap. The terminal part 32 has an electric wire connection section for screwing to connect a wire for transmitting a voice signal to external circuits and a shield wire and at the same time, has electrodes electrically integral to the electric wire connection section, and each electrode is electrically connected to the electrode pattern 25. The material of the terminal part 32 is arbitrary however, if integral molding of plastic, which is an insulating material, is employed, manufacture is simple. The material of the spacer 34 is also arbitrary and it may be an insulating material or a conductive material. The wiring pattern 28 connecting the circuit of the power module section 20 and the screw terminal section 23 and the high frequency noise countermeasure component 29 are enclosed by the spacer 34 in the three directions except in the direction of the shield case 30 side covering the power module section 20.

According to the embodiment described above, the terminal sections 22 and 23 on the input side and the output side are fixed on the substrate 21 so as to overlap with the high frequency noise countermeasure components 27 and 29. In other words, the high frequency noise countermeasure components 27 and 29 are interposed between the terminal sections 22 and 23 on the input side and the output side and the substrate 21. In order to secure a space in which the high frequency noise countermeasure components 27 and 29 are interposed between the terminal sections 22 and 23 on the input side and the output side and the substrate 21, the spacers 33 and 34 are interposed between the terminal sections 22 and 23 and the substrate 21. In such a configuration, the wiring patterns 26 and 28 for connecting the circuit section such as the low cut circuit and the output circuit belonging to the power module section 20 and the terminal sections 22 and 23 are formed along the minimum distance without being formed circuitously around the sides of the terminal parts 31 and 32. Therefore, it is unlikely that the external electromagnetic waves penetrate the wiring patterns 26 and 28 and thus, high frequency noises caused by the electromagnetic waves can be reduced considerably.

Figure 4:
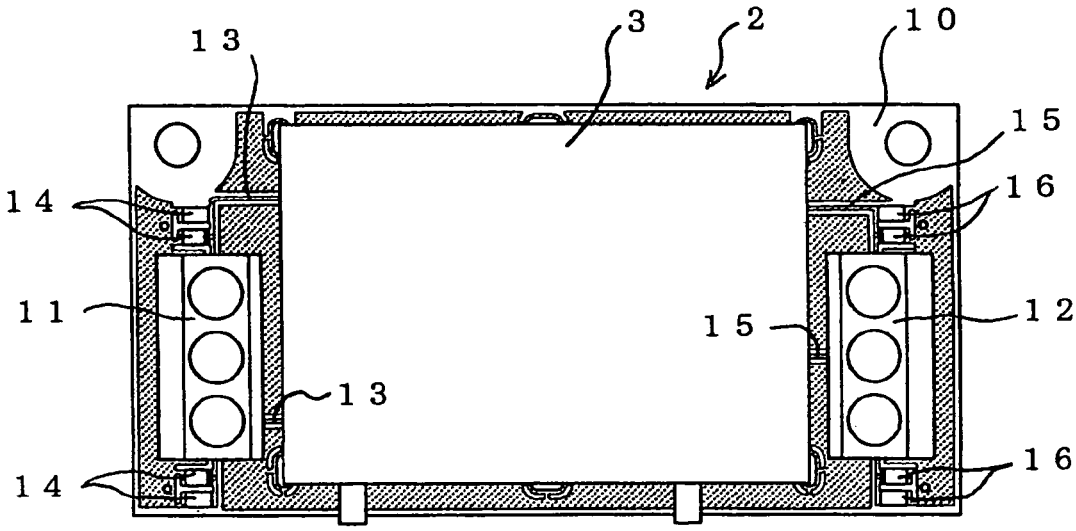
Fig. 4 (RELATED ART)
FIG. 4 is a top plan view showing a configuration example of a power module section of a conventional condenser microphone, with part of components being omitted.
Figure 5:
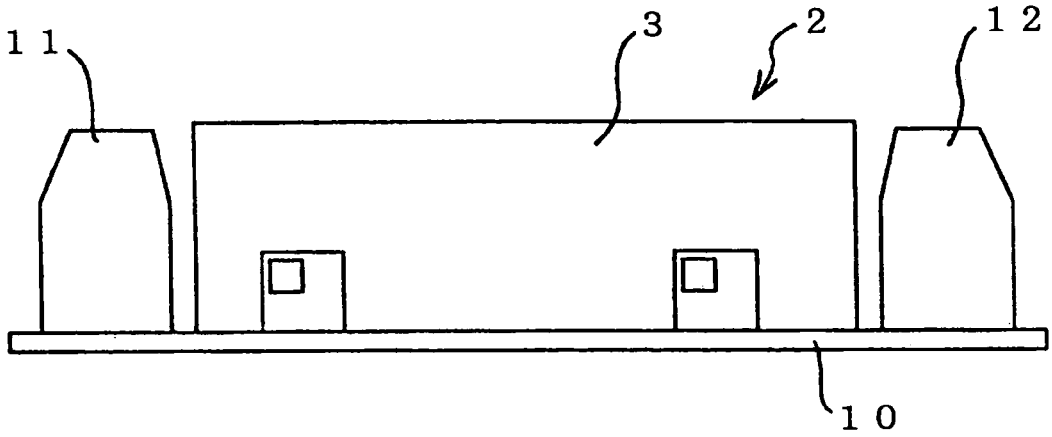
Fig. 5 (RELATED ART)
FIG. 5 is a front view of the conventional power module section.

The present invention is particularly effective as high frequency noise countermeasures in a condenser microphone in a form in which a microphone unit section including a microphone unit and an impedance converter and a power module section are separated and connected by a cable. In other words, the cable has a structure in which peripheral electromagnetic waves are likely to penetrate the cable and penetrate the power module section through the cable. However, according to the embodiment, the electromagnetic waves trying to penetrate the power module section 20 through the cable are released from the shield wire of the cable to the ground pattern 35 and the shield case 30. According to the configuration of the conventional power module section as shown in FIG. 4 and FIG. 5, there has been a problem that the electromagnetic waves once released to the ground penetrate through the exposed wiring pattern, however, according to the embodiment in the application of the present invention, since the wiring pattern is covered with the screw terminal section, the electromagnetic waves trying to penetrate the power module section 20 through the cable are released to the shield case 30 without being guided to the wiring pattern, therefore, it is possible to effectively reduce the high frequency noise caused by electromagnetic waves.

The screw terminal sections are provided on both the voice signal input side and the voice signal output side of the power module section 20 and the configuration effective for the high frequency noise countermeasures is employed on both the input side and the output side, therefore, it is possible to further effectively reduce high frequency noises.

The wiring pattern connecting the circuit of the power module section 20 and the screw terminal section and the high frequency noise countermeasure component are enclosed by the spacers 33 and 34 in the three directions except in the direction of the shield case 30 side covering the power module section 20 on both the input side and the output side, therefore, it is possible to further effectively prevent electromagnetic waves from penetrating from the screw terminal section.

Generally, a condenser microphone according to the present invention is applicable to a condenser microphone in a form in which a microphone unit section and a power module section are separated and connected by a cable. Therefore, it is suited to a microphone that is suspended from the ceiling such as a microphone for a church choir and to a compact condenser microphone such as a conference microphone.

EXPLANATIONS OF LETTERS AND NUMERALS

20 power module section
21 substrate
22 screw terminal section
23 screw terminal section
26 wiring pattern
27 high frequency noise countermeasure component
28 wiring pattern
29 high frequency noise countermeasure component
30 shield case
33 spacer
34 spacer

What is claimed is:

1. A condenser microphone in a form in which a microphone unit section and a power module section are separated and connected by a cable, wherein:

the power module section has a substrate, a screw terminal section fixed on the substrate and connecting the cable;

the substrate has a wiring pattern for connecting a circuit of the power module section with the screw terminal section and a high frequency noise countermeasure component connected to the wiring pattern; and the screw terminal section is fixed on the substrate so as to cover the high frequency noise countermeasure component, wherein a spacer is interposed between the substrate and the screw terminal section and the high frequency noise countermeasure component is stored within a height of the spacer.

2. The condenser microphone according to claim 1, wherein the screw terminal sections are provided at both a voice signal input side and a voice signal output side of the power module section.

3. The condenser microphone according to claim 1, wherein the wiring pattern connecting the circuit of the power module section and the screw terminal section and the high frequency noise countermeasure component are enclosed by the spacer in the three directions except in the direction of the shield case side covering the power module section.

4. The condenser microphone according to claim 1, wherein the high frequency noise countermeasure component is a capacitor.

5. The condenser microphone according to claim 1, wherein the microphone unit section comprises a microphone unit and an impedance converter.

6. The condenser microphone according to claim 1, wherein the power module section incorporates a low cut circuit and an output circuit.

* * * * *